US005335485A

United States Patent [19]

Cappi et al.

[11] Patent Number: 5,335,485

[45] Date of Patent: * Aug. 9, 1994

[54] FLEXIBLE BAG DISPENSING APPARATUS FOR USE IN SUPERMARKETS AND THE LIKE

[75] Inventors: Angelo Cappi, Modena; Renato Rimondi, Bologna, both of Italy

[73] Assignee: A.W.A.X. Progettazione E Ricerca S.R.L., Vignola, Italy

[ * ] Notice: The portion of the term of this patent subsequent to Dec. 1, 2009 has been disclaimed.

[21] Appl. No.: 924,367

[22] Filed: Jul. 31, 1992

Related U.S. Application Data

[63] Continuation of Ser. No. 613,234, Nov. 14, 1990, abandoned.

[30] Foreign Application Priority Data

Nov. 21, 1989 [IT] Italy ..... 22456 A/89

[51] Int. Cl.[5] ..... B65B 41/12; B65B 43/26; B65B 67/12

[52] U.S. Cl. ..... 53/570; 53/250; 53/384.1; 53/389.1; 53/391; 186/66

[58] Field of Search ..... 53/384.1, 389.4, 389.5, 53/567, 570, 390, 250, 251, 391; 225/100, 101, 106; 493/193, 194, 195; 186/66

[56] References Cited

U.S. PATENT DOCUMENTS

| | | | |
|---|---|---|---|
| 2,902,811 | 9/1959 | Joyce . | |
| 3,025,651 | 3/1962 | Stanley . | |
| 3,057,527 | 10/1962 | Hannon . | |
| 3,190,049 | 6/1965 | Van Der Meulen . | |
| 3,431,706 | 3/1969 | Stuck . | |
| 3,564,814 | 2/1971 | Gravely . | |
| 3,626,662 | 12/1971 | Gravely . | |
| 3,699,741 | 10/1972 | Norman . | |
| 3,740,922 | 6/1973 | Liou . | |
| 3,754,370 | 8/1973 | Hanson . | |
| 3,792,565 | 2/1974 | Goransson | 53/567 |
| 3,942,694 | 3/1976 | Jones et al. . | |
| 4,070,951 | 1/1978 | Bala . | |
| 4,085,822 | 4/1978 | Osborn . | |
| 4,230,204 | 10/1980 | Langen et al. . | |
| 4,284,221 | 8/1981 | Nagel et al. . | |
| 4,306,633 | 12/1981 | Langen et al. . | |
| 4,484,662 | 11/1984 | Busch . | |
| 4,493,684 | 1/1985 | Bolton . | |
| 4,514,962 | 5/1985 | Ausnit . | |
| 4,651,506 | 3/1987 | Lerner et al. | 225/106 X |
| 4,726,170 | 2/1988 | Sawa et al. | 53/570 |
| 4,730,762 | 3/1988 | Felix . | |
| 4,774,796 | 10/1988 | Aiuola et al. | 53/389.5 X |
| 4,835,948 | 6/1989 | Humphrey . | |
| 4,909,356 | 3/1990 | Rimondi et al. . | |
| 5,167,301 | 12/1992 | Cappi et al. | 186/66 |

FOREIGN PATENT DOCUMENTS

| | | |
|---|---|---|
| 0363335 | 4/1990 | European Pat. Off. . |
| 1509727 | 5/1978 | United Kingdom . |

*Primary Examiner*—John Sipos
*Assistant Examiner*—Linda B. Johnson
*Attorney, Agent, or Firm*—Cohen, Pontani, Lieberman, Pavane

[57] ABSTRACT

Apparatus suitable for disposition in supermarkets and the like for dispensing, in open condition, plastic or otherwise flexible bags for receiving therein articles purchased on site. The apparatus includes a reel formed of a continuous web of bags serially attached together in end-to-end relation, and a device for unwinding the continuous web from the reel and for advancing the web so as to transport the leading bag to a bag opening and retaining device. At the opening device, the leading bag is detached from the continuous web, a pair of relatively movable grippers grasps the opposite faces of and opens the bag, and the opened bag is supported by a vertically-movable loading platform as articles are introduced into the bag through a hopper located immediately above the platform-supported open bag.

19 Claims, 5 Drawing Sheets

FLEXIBLE BAG DISPENSING APPARATUS FOR USE IN SUPERMARKETS AND THE LIKE

This is a continuation of U.S. application Ser. No. 07/613,234, filed Nov. 14, 1990 now abandoned.

FIELD OF THE INVENTION

The present invention relates to apparatus for facilitating the packing of articles, such as those purchased at a retail establishment, in bags and, more particularly, to such apparatus which automatically feeds, opens and positionally maintains in an open condition a flexible bag into which articles to be packed are readily introducible.

BACKGROUND OF THE INVENTION

It is common today that, at the sales or checkout counters of supermarkets and other like retail establishments, items or articles purchased by a customer are customer-carried or otherwise transported from the store in flexible bags typically formed, by way of example, of a nonelastic plastic material. These bags are generally provided by the supermarket or other store and are often packed or filled, by hand, directly by the customer. This is a particularly uncomfortable operation, requiring a great deal of time and patience from the customer who must hold the bag open with one hand while moving articles, one after another, from a moving transport belt or checkout counter surface and into the bag. These bags are, furthermore, conventionally provided to the store or checkout station in the form of stacked packs or as continuous strips of bags so that the customer must, in addition, physically detach or separate each bag from the pack or strip prior to attempting to manipulate his or her purchases into the bag. Such operations are generally, and not incorrectly, perceived by the customer as a nuisance and a waste of time and are therefore often deleterious to the customer's attitude toward and relations with the supermarket or other establishment.

OBJECTS AND SUMMARY OF THE INVENTION

It is accordingly an object of the present invention to provide an apparatus constructed and operable for eliminating the above-noted drawbacks and inconveniences and for enabling the customer, or an employee of the establishment, to use both hands in introducing articles into the bag and thereby as much as halve the amount of time necessary to fill the bag.

This and other objects are achieved in accordance with the present invention by an apparatus which includes a bag dispensing device and a bag opening device. The dispensing device is operable for unwinding a reel formed of a continuous web of frangibly-attached bags, for detaching the leading bag from the remainder of the web and for transporting the leading bag to the superposed opening device. The opening device, in turn, grasps the opposite faces of the bag to open the same and supports the open bag while it is filled with articles introduced through a hopper located immediately above the open bag. The apparatus preferably also incorporates a loading device for supporting the bottom, or effective bottom, of the bag during the filling thereof, and for then ejecting or discharging the filled bag from the apparatus interior.

The inventive apparatus is particularly, although not exclusively, intended for disposition in supermarkets and other similar points of sale for dispensing, one at a time, plastic or otherwise flexible bags unwound from a continuous web reel, for opening each dispensed bag and for retaining the bag in an open condition under a hopper through which either the customer or the supermarket personnel may introduce the purchased articles.

The apparatus of the present invention has the further advantage of being unusually simple in structure and therefore exhibiting high reliability at relatively low cost. Moreover, the apparatus is of unusually reduced size so that it may conveniently be placed at any suitable point or location in, for example, a supermarket, including closely proximate or even integrally within a checkout counter. This last feature advantageously enables supermarket personnel to participate in or take over bag filling operations.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENTS

Figure 1:
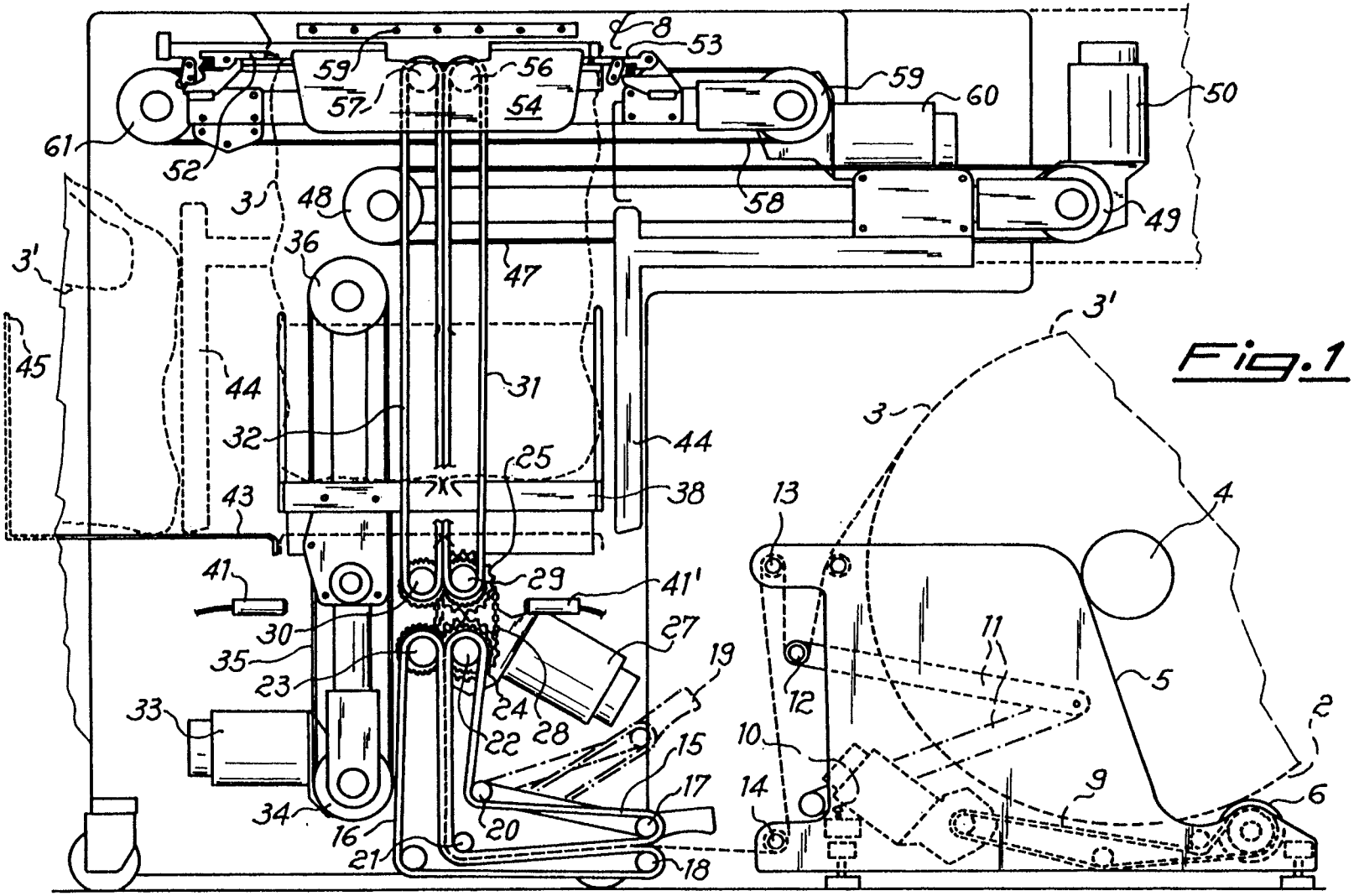
FIG. 1 is an elevated cross-sectional side view of an apparatus constructed in accordance with the present invention.

The present invention is directed to an apparatus, particularly (although not exclusively) suitable for use at the checkout counters or stations of supermarkets and other retail establishments, for dispensing individual bags from a continuous strip or web thereof, for opening and maintaining a dispensed bag in an open, article-receiving condition and location, and for discharging the bag, when filled in accordance with the bag's volumetric size or capacity and/or the particular articles to be placed therein, from the apparatus. With initial reference to FIG. 1 in which pertinent operating portions of the apparatus are illustrated in a cross-sectional side view, a continuous strip or web 2 of bags 3 wound about a central core 4 forms a reel 1 seen at the lower right-hand corner of the drawing. The web, and the bags 3 forming the same, may by way of example be fabricated of a flexible and preferably inelastic material such as polyethylene, polypropylene or polyvinylchloride or the like. The bags are preferably joined or individually delineated, one from another along the web 2, by perforations or other means for facilitating separation of individual bags from the web by, for example, applying oppositely directed forces to adjacently-disposed bags as will hereinafter become apparent. The ends of the central core 4 protrude laterally outwardly from the sides of the reel 1 and are supported or rest on the inclined edges 5 of spaced apart panels that laterally bound or house at least a portion of the reel 1. The periphery of the reel of bags 3 rests atop a rubberized roller 6, the roller 6 being operatively rotatable by a reduction motor 7 and a chain 9 connecting the motor and rubberized roller for unwinding the web 2 from the reel when additional bags are to be dispensed. Motor 7 is operable for rotating the roller 6 only, however, when the actuating element of a microswitch 10 is not depressed by the lower part or arm of a rocking lever 11.

The upper part or arm of the lever 11 carries, at its free end, a tensioning roller 12 about which the continuous strip or web 2 of bags 3 is partly trained. When it is desired to advance a bag 3 to the open hopper 8, defined at the top of the apparatus, to be there opened for the receipt of articles therein, the cashier or other operator of the apparatus presses a switch or button that actuates a reduction motor 27 for initiating a bag feeding operation of the bag dispensing means. The continuous web 2 is thereby advanced upwardly along its travel path, tensioning the web and upwardly displacing the tensioning roller 12 whereby the upper arm of the rocking lever 11 is raised. The lower arm of the lever 11, pivoting about its lowermost end, is thus also raised and moves out of depressing contact with the microswitch 10 whereby the motor 7 is actuated and the rubberized roller 6 is rotated to effect unwinding of the reel 1. Support of the central core 4 of the reel 1 by the housing panel inclined edges 5 assures that the reel remains continuously supported by the rubberized roller 6 that controls the selected unwinding of the web 2.

From the tensioning roller 12, the continuous web or strip 2 is guided about idler rollers 13, 14 that redirect the web into the entry nip defined between lower driving belt units 15, 16. Each of the belt units 15, 16 is formed of a plurality of substantially parallel, transversely adjacent flat belts arranged for contact with one of the opposed faces of the bags 3 that connectedly form the continuous web 2. The exact number of belts provided in each unit 15, 16 is determined in accordance with the range of bag and web sizes that the apparatus of the invention is intended to accommodate; in the embodiment herein described each unit 15, 16 incorporates nine such belts for contact with each bag over substantially the entire face width thereof. The driving belt units 15, 16 are cooperatively disposed and operated so as to act on the respectively opposite faces of the bags and thereby grip the bags for transport between the opposed belts.

The plural belts of the units 15, 16 rotate about respective lower rollers 17, 18 and driving rollers 22, 23. Roller 17 is connected to one end of a manually-displaceable lever 19 by which the roller 17 may be raised or otherwise moved away from the roller 18 to facilitate insertion of the web 2 between belts 15, 16 when, for example, replacing an exhausted reel 1. Such displacement of the lever 19—as indicated by the broken line depiction in FIG. 1—and roller 17 is effected about a fulcrum defined by a first interposed roller 20 about which the belts of the lower driving belt unit 15 are trained. The belts of both the first and second lower driving belt units 15, 16 are similarly trained about a second interposed roller 21 disposed relative to the lower rollers 17, 18 and the driving rollers 22, 23 so that the opposed belts of the units 15, 16 are maintained in close, surface-to-surface contact at that portion or elbow of their runs at which the initial, substantially horizontal feeding of the web 2 is shifted to a substantially vertical feed.

The belts of the opposed web transport units 15, 16 are driven by rotation of driving rollers 22, 23; in the disclosed arrangement, the rollers 22 is directly rotated by the motor 27, and the roller 23 is linked to and for rotation with the roller 22 by a pair of toothed wheels respectively keyed or connected to the rollers. Roller 22 also carries a pinion 24 which, by way of a chain 28, is linked to a corresponding pinion 25 carried on an upper roller 29. The operative rotation of roller 22 is thus transferred to the upper roller 29 and, from there, to an adjacently-disposed upper roller 30 through the meshed engagement of a pair of toothed wheels respectively connected to the rollers 29, 30 in a manner analogous to the linking of the driving rollers 22, 23. The upper rollers 29, 30 form, in conjunction with idler rollers 56, 57 and a plurality of drive belts trained thereabout, the respective lower ends of two sets or pairs of opposed upper driving belt units 31, 32. Thus, the motor 27 operatively drives both of the rollers 22, 23 of the lower belt units 15, 16 and, through the linkage of chain 28, the upper rollers 29, 30 of the two upper belt units 31, 32.

The opposed belts of the lower units 15, 16 press against each other about the second interposed roller 21, gripping therebetween the continuous bag strip 2 so that, as the belts are thereby rotated, the web or strip is driven upwardly toward the superposed bag opening device. The opposed, rotating or moving belts of the upper belt units 31, 32 similarly grip therebetween the continuous web 2 which is advanced from the underlying transport or dispensing device and further advance the web toward the bag opening device of the present invention.

Interposed between the bag dispensing device and the superposed opening device is a bag loading apparatus or device. The loading device is comprised of a reduction motor 33 operable for rotating a drive pulley 34, an idler pulley 36, a cable 35 trained about the pulleys 34, 36, a slide 37 and a bag loading plate or platform 38 secured to the slide. The slide 37, and the bag loading plate secured thereto, are vertically movable as the motor driven rotation of the drive pulley 34 is imparted to and effects movement of the cable 35. The loading platform 38 is formed of two half-plates separated by a central aperture 39 through which empty bags are passable in their ascending motion as will hereinafter be apparent.

In operation, single or individual bags 3 are detached from the continuous web 2 by reversing the direction of rotation of the rollers 22, 23 and of the belts of the lower units 15, 16 thereby driven, while discontinuing and preventing further rotation of the rollers 29, 30. This operation—which is hereinafter described with specific reference to FIG. 2—is enabled by the provision of two freewheels 26, 26' keyed or mounted on the roller 29. Reversing of the rotative direction or sense of motor 27 and of the rollers 22, 23 is controlled by the opposed elements 41, 41' of a photocell array between which the continuous web 2 passes as the web is advanced by the lower and upper driving belt units. For this purpose, the web 2 may advantageously comprise a continuous stream or succession of attached bags 3 wherein the bottom of each bag is joined to the upper ends of handles which are defined in the immediately adjacent or following or subsequent bag. The serially connected bags in and defining the continuous web have their tops leading their bottoms in the advancing direction of web movement. As previously pointed out, the end-to-end attachment of adjacently-disposed bags may, for example, be by way of a perforation or other frangible joinder permitting ready separation of the leading bag from the web when oppositely-directed forces are applied across the perforation.

As a consequence of the preferred relative orientations of the adjacently-disposed and attached bags there is a periodic alternation of full and empty spaces along the web 2, the full zones comprising those areas of the web defining the article-receiving bodies of the bags and each empty zone consisting of the open area bounded by the two handles and upper edge of one bag and by the bottom or lower edge of the immediately adjacent attached bag. During the upward motion of web 2 between the units 31, 32, the opposed photocell array elements 41, 41' are alternately obscured or blocked by the full zones and cleared or unblocked or lit as the empty bag zones are advanced through the area between them. Thus, when the lower edge of a bag 3 in the continuous web 2—more particularly of the leading bag—crosses or advances beyond the photocell array line or position, the elements thereof are lit, initiating the inversion or reversal of the rotative direction of the motor 27 and, thereby, of the rollers 22, 23 of the respective lower driving belt units 15, 16. The belt units 15, 16 thereby downwardly drive or retract the continuous web 2 while, at the same time, the freewheel 26' is locked so as to prevent further rotation of the rollers 29, 30 whereby the most upwardly disposed or advanced or leading bag 3 of the web is maintained stationary between the opposed belt units 31, 32. This operation effects tearing of the two small strip portions that join the bottom of one bag 3 to the upper end of the handles of the following, adjacent bag of the continuous web 2 and thus results in the physical separation of the leading bag from the remainder of the web.

After the leading bag 3 has thus been detached from the web 2, the rotative direction of the motor 27 returns to its original sense—i.e. that preceding the reversal. The rollers 22, 23 and associated lower belt units 15, 16 thereby once again initiate the forward or upward advance of the web and the single, now-detached bag 3 is transported by the upper belt units 31, 32 to a position immediately under the hopper 8.

Having arrived at the hopper 8, the detached bag 3 is opened by the opening device of the inventive apparatus and takes on the general shape depicted in broken line in FIG. 1. The Figure also indicates, again in broken line, the uppermost position attainable by the two halves of the bag loading platform 38 upon which the bottom or effective bottom of each bag 3 is supported as the bag is filled; this represents the vertical position of the loading platform 38 at the beginning of the bag filling step. In this manner single items introduced into a bag 3 through the hopper 8 need not traverse an excessively long drop from the hopper to the bag bottom and the chances of such items violently bumping against or of being otherwise transported into article-damaging or deforming contact with the platform-supported bottom of the bag are reduced.

When all or substantially all of the initially available interior volume of the platform-supported bag 3 has been filled with articles, the loading platform 38 descends to an intermediate position (FIG. 1) at which the bag 3 is subjected to a second filling step. At the conclusion of this second step—e.g. with the available bag volume once again filled—the loading platform descends further to its lowest position (also depicted by broken lines in FIG. 1) at which the platform 38 lies at the same height or level as an ejection plate 43. It should be noted that, in the herein disclosed form of the inventive apparatus, the difference in vertical height between the intermediate and lowest positions of the loading platform 38 is relatively small and is merely intended to cause the topmost articles contained in the bag to further descend below the hopper 8 and the bag opening device. This assures that these articles will not, undesirably, bump against or be otherwise brought into contact with the hopper 8 or the bag opening device as the filled bag 3' is ejected from the apparatus. Thus, no further filling or addition of articles to the bag 3 should take place once the platform 38 begins its descent from its intermediate position.

The filled bag 3' is next shifted or displaced, to the left in FIG. 1, slidably onto and along the ejection plate 43 by an ejector 44 that drives the bag toward and through an opening in the apparatus wall whereby the bag is discharged from the interior of the apparatus. The horizontally reciprocating motion of the ejector 44 is controlled by a slide 46 (FIG. 1) which is linked by a cable 47 to a driven pulley 49 directly rotated by a reduction motor 50 and an associated idler pulley 48. In the Figure, the solid line depiction of the ejector 44 illustrates the ejector's initial or rest position and the dotted lines indicate an intermediate position in the course of a bag discharge or ejection operation. A guard 45 may be provided at the outbound end of the ejection plate 43 for advantageously preventing the filled bag 3' from falling over or otherwise spilling its contents before being removed from the ejection plate by the customer.

The loading device of the inventive apparatus further includes a second photocell array 51 disposed immediately below the upper edge of the hopper 8. The photocell elements of this second array are effective to detect when articles introduced into a bag 3 have reached a predetermined maximum level and, should the photocell elements remain blocked or obscured at the end of the bag filling operation—i.e. when the filling platform 38 has descended from its intermediate to its lowest position—operation of the motor 50 for displacing the ejector 44 is prevented. This is effective to avoid subjection of an overfilled bag to displacing movement by the ejector in which damage to the bag and contained articles and potential jamming or damage to the bag opening device could occur. Once the excess articles contained in the bag have been removed, the photocell elements of the array 51 are unblocked or relit and cease to prevent operation of the motor 50, thus permitting the ejector 44 to horizontally discharge the filled bag from the apparatus interior along the ejection plate 43.

The bag opening device is formed of opposed and operatively-cooperating left and right pliers or grippers 52, 53, respectively, and a pair of tiltable flaps 54, 55 disposed substantially perpendicular to the grippers. As seen in FIG. 1, the grippers 52, 53 lie immediately below or inwardly of two opposite sides of the hopper 8, and the tiltable flaps 54, 55 lie just below or inwardly of the other two opposite sides of the hopper. The flaps 54, 55, are pivotally movable between a first or horizontal position and a substantially vertical second position. In the first position, when the device is stationary, the hopper is closed or obstructed by the flaps so as to prevent the passage of articles through the hopper when no bag 3 is suitably positioned for their receipt. In the second position, illustrated in broken lines in FIG. 1, the bag 3 is positioned for receiving articles and the hopper is thereby opened or nonobstructed so as to permit the introduction of articles therethrough and into the bag.

The grippers 52, 53 are actuated by a reduction motor 60 through a cable 58 and respective drive and idler pulleys 59, 61. One of the grippers is linked to the upper branch or leg or run of the cable 58 and the other to the lower branch thereof so that, under the driving action of cable 58, the grippers are movable between a first position of maximum separation, illustrated in FIG. 1, and a second or meeting position of overlapped adjacency located at or closely proximate the center line of the hopper 8. When the grippers 52, 53 so meet, they operatively grasp the top edges of the two opposite faces of a plastic bag 3 which is thereby opened when the grippers, in returning from their second to their first positions of spaced apart relation, carry with them the opposite bag faces firmly grasped by the grippers. Immediately after or substantially concurrently with the returning grippers 52, 53 reaching their first positions the flaps 54, 55 are pivoted or otherwise moved downward from their horizontal to their substantially vertical positions by action of a solenoid or electromagnetic actuator 62 (FIG. 2).

In their downwardly pivoted or substantially vertical or second position, the flaps 54, 55 extend into the interior of the bag 3, against or at least proximate the opposed bag walls or sides, and thereby maintain these opposed bag sides in suitably spaced apart relation so as to permit the introduction of articles into the bag interior. It is generally contemplated that, where the bag includes gussets or bellows or the like, the flaps 54, 55 maintain the spacing or separation of the gusset-bearing sides of the bag. In this position—i.e. with two opposed faces of the bag 3 firmly grasped by the respective grippers 52, 53 and the other two opposed bag faces held apart by the downwardly-extending flaps 54, 55—the bag is thus maintained in its fully open condition with a generally cross-sectionally rectangular opening located immediately below the hopper 8. The exact manner in which the bag opening device of the invention operates is described in greater detail, with particular reference to FIGS. 4A to 5D, below.

Figure 2:
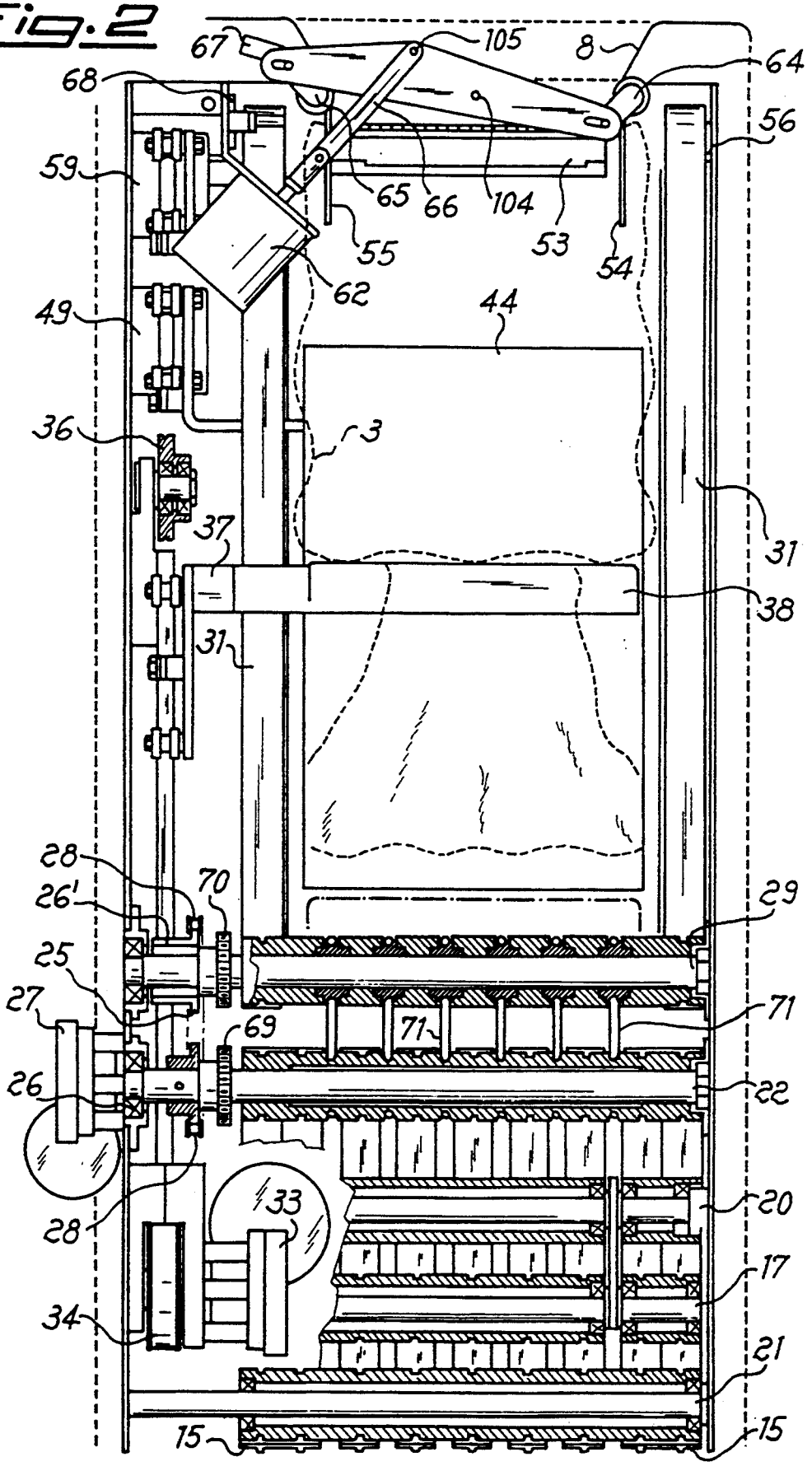
FIG. 2 is an elevated cross-sectional end view orthogonal to and depicting the apparatus of FIG. 1.

In FIG. 2—which is an elevated downstream end view orthogonal to the depiction of FIG. 1—the gripper 53 is seen grasping the top portion of the bag 3 in its open position and the flaps 54, 55 are illustrated, in profile, in their downwardly or vertically-oriented disposition spacing apart the opposed sides of the bag. Pivoted movement of the flaps 54, 55 into their vertically-oriented position in accordance with the operation of the solenoid 62 is effected by way of a rocking lever 63, one end of which is hingedly connected to a hub 64 of the flap 54 and the other end being hingedly connected to a hub 65 of the flap 55. The rocking lever 63 is further linked, at a location off-centeredly intermediate its ends, to the solenoid 62 by an arm 66. The end of rocking lever 63 most closely proximate solenoid 62 carries an extension 67 that, when the extension-carrying end of lever 63 is lowered under the action of a return spring (not shown), presses on a security sensor 68. Actuation or excitation of solenoid 62 drives arm 66 through an upward movement that causes a pivotal rotation of rocking lever 63 about its fulcrum 104, the ends of the rocking lever thus effecting clockwise and counterclockwise, respectively, rotations (as seen from the orientation of FIG. 2) of the hubs 65, 64. The hub rotations, in turn, drive the pivotal displacement of the attached flaps 55, 54 from their first, generally horizontal to their second, substantially vertical orientations. Additional particulars of the operation of these elements will be described hereinbelow.

Also seen in FIG. 2 is the upper half or portion of a bag 3 supported, at least in part, on the loading platform 38 for accomodating the introduction of articles into the bag. The lower end of the bag 3 hangs loosely down beyond the platform 38, extending through the aperture 39 that separates the two half-plates of the loading platform 38 and through which the bag passes in its ascension toward the superposed bag opening device.

The connection between the lower belt unit rollers 22, 23—by which the rotation directly imparted to roller 22 by motor 27 is transferred to roller 23—is implemented by the meshed engagement of a toothed wheel 69 on roller 22 and a correspondingly toothed wheel 69′ keyed on roller 23. The driving roller 22 is additionally provided with a pinion 24 that is linked by chain 28 to a pinion 25 mounted on the upper roller 29. Chain 28, in conjunction with the pinions 24, 25, effects a transfer of the motor-driven rotary motion of roller 22 to the upper belt unit roller 29. The resulting rotation of roller 29 is, in turn, transferred to the adjacently-disposed roller 30 through the meshed engagement of a toothed wheel 70 on roller 29 with a like toothed wheel (not visible in FIG. 2) on roller 30. In this manner the opposed belts of the upper driving belt units 31, 32 are driven about the respective roller pairs 29, 56 and 30, 57 to carry upwardly or advance a bag 3 which is disposed between the belts into article-receiving position under the hopper 8.

The pinion 25 on roller 29 carries, as seen in FIG. 2, a freewheel 26 that permits rotation of the roller 29 in only a single sense—i.e. in the clockwise direction (in FIG. 1) by which a bag disposed between the belt units 31, 32 is upwardly advanceable. When the rotative direction of chain 28 is reversed by reverse rotation of the motor 27, the freewheel 26 idles, roller 29 is accordingly no longer driven and the web or bag-advancing motion of the upper belt units 31, 32 is discontinued. As previously pointed out, detachment of the leading bag 3 from the remainder of the web is effected by reversing the rotative direction of the opposed belts of the lower units 15, 16—between which the web is concurrently held or disposed—while the upper belt units 31, 32 between which the leading bag is grasped are maintained stationary. In order to assure that none of the withdrawing or downward or return movement of the web driven by the lower belts units 15, 16 is transferred or imparted to the upper belt units 31, 32 through the web which spans the lower and upper units, the roller 29 further carries a second freewheel 26′. The second freewheel 26′ is arranged so as to idle freely as the roller 29 rotates in its (FIG. 1) clockwise sense for upwardly advancing a bag, but is locked against counterclockwise or oppositely-directed rotation of the roller 29. Thus, the second freewheel 26' is effective to prevent all counterclockwise (in FIG. 1) rotation of the roller 29 and, accordingly, all bag or web withdrawing motion of the upper belt units 31, 32—such, for example, as could otherwise occur as the web is withdrawn by the lower units 15, 16 during reverse rotation of the driving roller 22. The upper belt units 31, 32 are thus assured of remaining absolutely stationary during the detachment or separation of a leading bag 3 from the remainder of the web 2.

A plurality of relatively small, circular belts 71—six such belts are illustrated in FIG. 2—trained about the rollers 22, 29 are disposed in the free space between these rollers. The belts 71 provide suitable guidance for the web 2 in its transitional motion between the lower belt units 15, 16 and the superposed upper belt units 31, 32.

In a preferred form of the apparatus of the invention, the two outermost ones of the plural belts forming each of the lower driving belt units 15, 16 are disposed in substantially edge-to-edge relation so as to define web-grasping regions of twice the width as that provided by the other belts located between the two outermost extremes of each belt unit. In FIG. 2, for example, may be seen a portion of the lower belt unit 15 in which five normally spaced-apart belts are located between two pairs of double-width or lateral edge-to-edge belts at the transverse sides of the unit. By virtue of this arrangement, enhanced dragging of the lateral portions of the web 2, at which are commonly disposed the handles of each single bag 3, is realized. The doubled width of the outer belt pairs is, preferably, substantially the same or at least as great as the width of the flattened handles of the bags 3.

Figure 3:
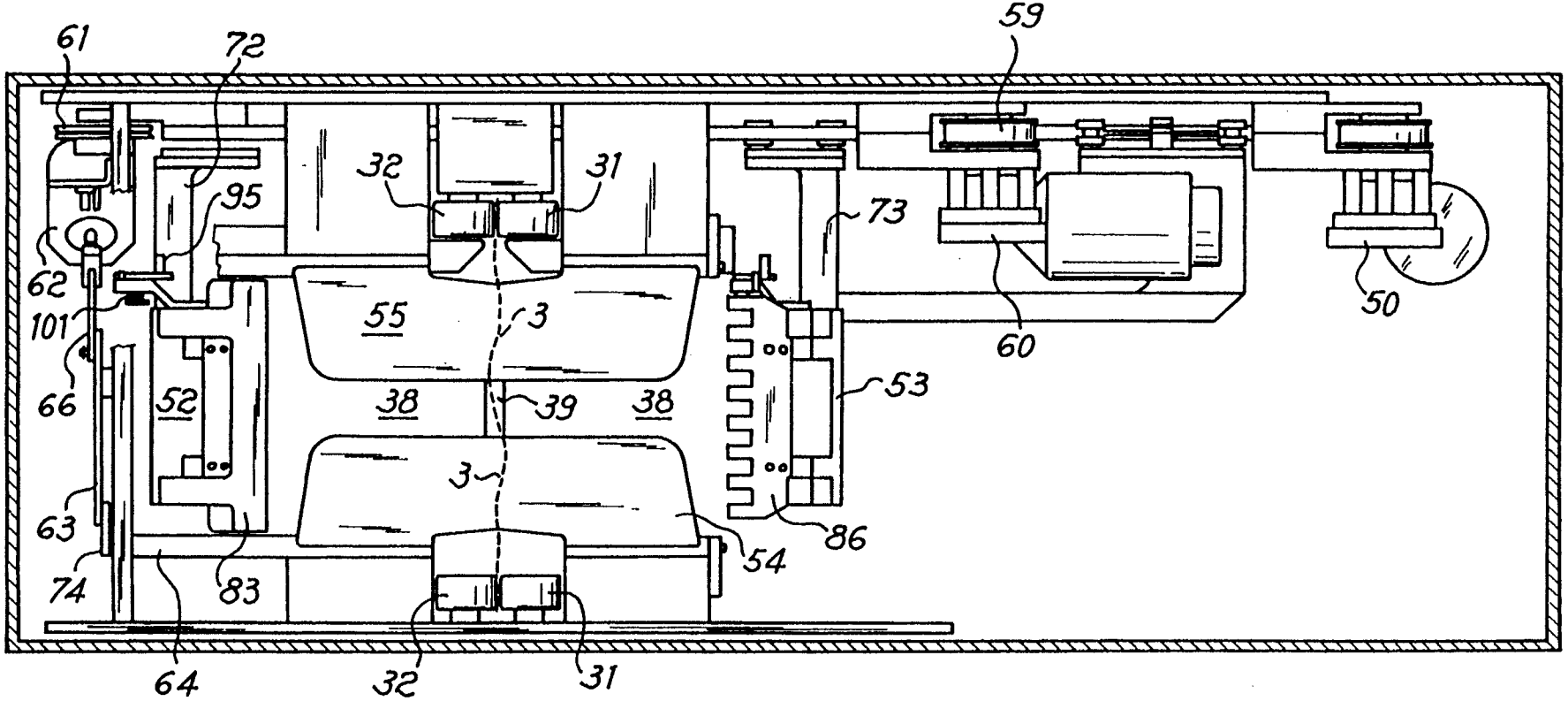
FIG. 3 is a top plan view of the apparatus of FIGS. 1 and 2.

The hinged connections between the rocking lever 63 and the hubs 64, 65 which carry the pivotally displaceable or tiltable flaps 54, 55, respectively, are illustrated in FIG. 3. A small interposed lever 74 has one of its ends pivotally attached to an end of the rocking lever and its other end secured to the hub 64. A like lever (not shown, for clarity, in FIG. 3) is interposed between the opposite end of the rocking lever 63 and the hub 65.

With further reference to the top plan view of FIG. 3, the motor 60 is operable to rotate the drive pulley 59 and, thereby, the cable 58 trained about the drive and idler pulleys 59, 61. The gripper 52 is carried on a bracket 72 and the gripper 53 is carried on a bracket 73, each of the brackets 72, 73 being, in turn, secured to the cable 58 for movement therewith. The tiltable flaps 54, 55—here seen in their substantially horizontal orientations effective for preventing entry into the bag 3 of items inadvertently or prematurely introduced into the top of the hopper 8—are disposed substantially perpendicular to the grippers 52, 53. Seen below the flaps 54, 55 are the two half-plates of the loading platform 38, spaced apart by the central aperture 39 through which a bag 3 (depicted by the dotted lines) is upwardly advanceable by operation of the upper belt units 31, 32.

Figures 4A, 4B, 4C, 4D, 5A, 5B, 5C, 5D:
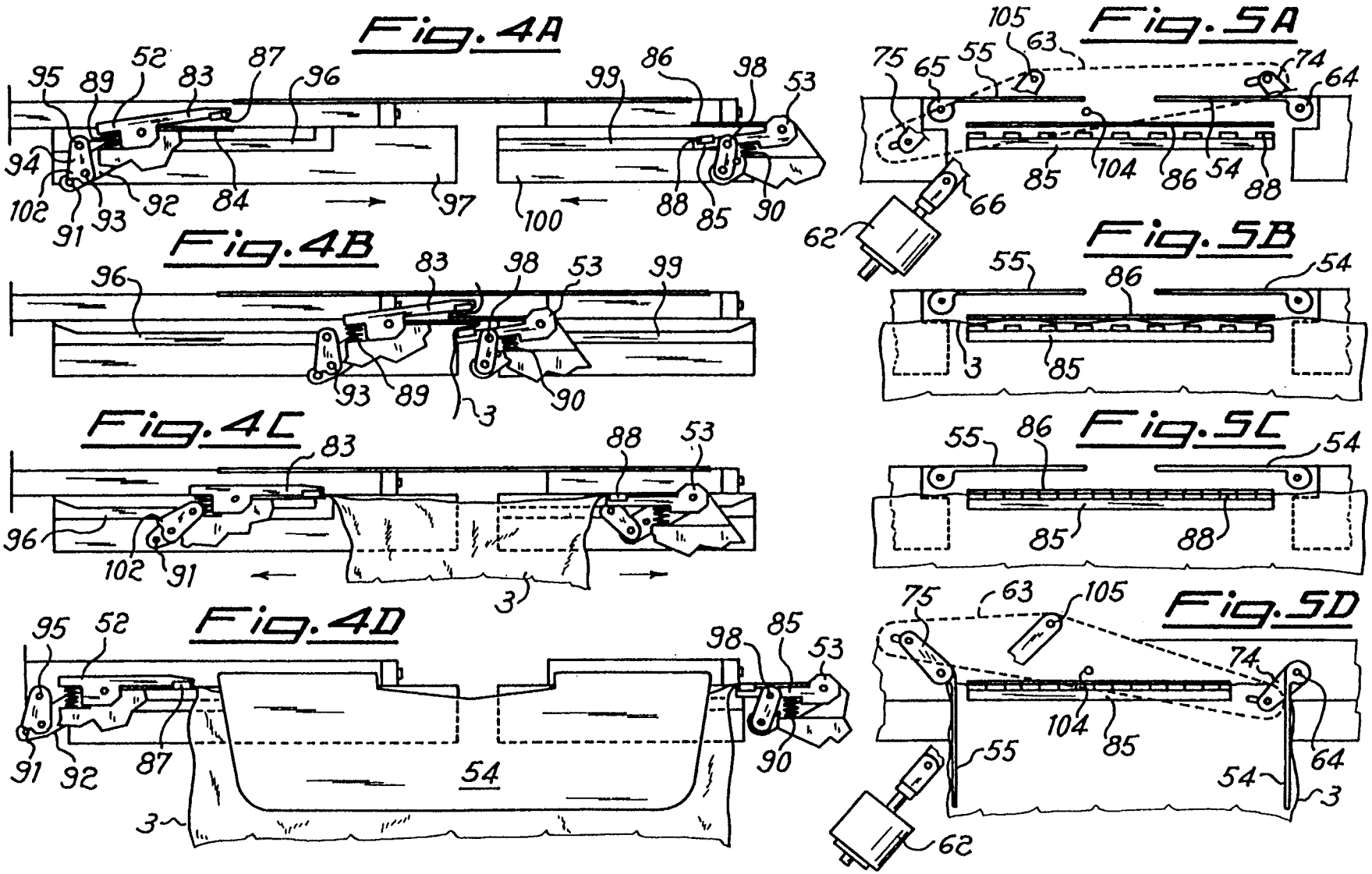
FIGS. 4A to 4D are side views successively illustrating the bag opening device of the inventive apparatus at four discrete times in the course of a bag opening operation.
FIGS. 5A to 5D are end views, similar to FIGS. 4A to 4D, of the bag opening device of the invention at four discrete times in the course of a bag opening operation.

The top or upper part or arm 83 of the gripper 52 carries, on its lower face, a plurality of spaced apart rubberized blocks 87 (FIG. 4A). The lower part or arm 84 of the gripper 52 is configured to provide a series of recesses sized and shaped and spaced apart in accordance with the size, shape and spacing of the blocks 87 so that the blocks are movably receivable in and through the recesses. The gripper 53 is similarly formed of a lower part or arm 85 carrying, on its upper face, a plurality of spaced apart rubberized blocks 88 and a top or upper part or arm 86 configured, in the manner of the arm 84, to provide a series of recesses sized and shaped and spaced apart so that the blocks 88 are movably receivable in and through the recesses. Thus, the grippers 52, 53 are similarly constructed but are disposed or oriented in reverse or inverted or upside-down relation to each other—i.e. the top arm 83 of the gripper 52 is constructed in the manner of the lower arm 85 of the gripper 53, and the lower arm 84 of the gripper 52 is constructed in the manner of the upper arm 86 of the gripper 53.

In operation, the grippers 52, 53—carried on the motor-driven cable 58—advance until they meet and partly intermesh or interpenetrate so as to hold or grasp a bag 3 therebetween. More particularly, as the left and right (in the Figures) grippers 52, 53 are brought into intermeshed proximity the rubberized blocks 87 located on the lower surface of the left gripper upper arm 83 pass through the recesses of right gripper upper arm 86 until they abut left gripper lower arm 84, while the rubberized blocks 88 of the right gripper lower arm 85 abut the right gripper upper arm 86 after first passing through the recesses of the lower arm 84 of the left gripper 52.

Further details of the operation of the bag opening device of the invention, separated into four discrete steps for ease of discussion and understanding, are illustrated in FIGS. 4A to 4D and 5A to 5D; the former depict an elevated side view similar to FIG. 1 while the latter show an elevated end view similar to FIG. 2. In FIG. 4A, both grippers 52, 53 are in their initial or open positions and have just commenced, as indicated by the arrows, their mutual approach under the action of motor 60 by way of the cable 58. The upper arm 83 of left pliers 52 can be seen to be carrying thereunder the plural rubberized blocks 87 intended to provide improved gripping of the face of a bag 3 when the opposed arms 83, 84 of gripper 52 close with the bag held between the arms. The left gripper 52 is normally biased toward the closed position of its opposed arms by a spring 89 that urges the working or block-carrying end of the upper arm 83 toward lower arm 84; a spring 90 similarly urges the block-carrying end of the right gripper lower arm 85 toward the upper arm 86. It should also be pointed out that the grippers 52, 53, in addition to being oriented in reverse or inverted relation to each other, are relatively offset one to the other so that the rubberized blocks of each gripper are in appropriate register with the corresponding recesses of the other gripper.

Disposition of the left gripper 52 in its open position or state is effected by upward displacement of a small lever 92 in opposition to the urgency or resistance of the spring 89. The small lever 92 is pivotally movable about a fulcrum 93 on a further lever 94. A pin 95 protrudes from the upper portion of the lever 94 and is receivable in and slidable along a groove 96 defined in a guide member 97 fabricated, by way of example, of polyamidic material in the form of a parallelepiped. The groove 96 begins (at its left side in FIGS. 4A to 4D) with a sloped or tapering chute by which the pin 95, as the left gripper 52 is advanced toward the right gripper 53, is initially driven downwardly into the central, substantially horizontal, elongated portion of the groove 96. As the pin is thus lowered, it carries with it the lever 94 causing the small lever 92 to pivot about the fulcrum 93 and pivotally displace the upper arm 83 away from the lower arm 84 so that the gripper 52 is opened. The groove 96 terminates, at its rightward end, in an upwardly-directed, substantially vertical leg which, when traversed by the pin 95, permits the left gripper upper arm 83 to pivotally return to the gripper-closing position under the urgency of the spring 89.

In a similar arrangement, the working end of the right gripper lower arm 85 is displaced downward against the urgency of the spring 90 to open the gripper 53 as a pin 98 enters and moves along a groove 99 defined in a guide member 100 fabricated, by way of example, of polyamidic material in the form of a parallelepiped. As with the groove 96, the groove 99 begins (at its right-hand end in FIGS. 4A to 4D) with a downwardly sloped or tapered chute; unlike the groove 96, the groove 99 does not terminate with an upwardly-directed leg. The guide member 100 is, in the currently disclosed embodiment of the invention, shorter than the member 97 and, as a consequence, the pin 98 is able to simply exit the leftward or downstream end of the groove 99 under the urgency of the spring 90.

Illustrated in FIG. 4B is the step or time at which the left and right grippers 52, 53 meet and partially intermesh or interpenetrate, both horizontally and vertically, with a bag 3 interposed therebetween. In this position the bag 3 is held firmly between the left gripper blocks 87 and lower arm 84 on one side and the right gripper blocks 88 and upper arm 86 on the other. The movement of pin 95 along groove 96 has carried it to the vertical leg of the groove within which it may rise, under the urgency of spring 89, to cause the lifting of lever 92 and the resulting closure of the opposed left gripper arms 83, 84 about a portion of the interposed bag 3. In a similar manner pin 98, having by this time arrived at and cleared the (leftward) end of groove 99, is free to rise under the urgency of spring 90 whereby the opposed right gripper arms 85, 86 are closed so as to grip between them another portion of the interposed bag 3.

With both the left and right grippers 52, 53 closed, the bag 3 has three adjacent zigzag-folded portions defined between the grippers. The uppermost portion lies between the rubberized blocks 87 of the upper arm 83 of the left gripper 52 and the upper surface of the upper arm 86 of the right gripper 53. The intermediate or central portion lies between the lower surface of right gripper upper arm 86 and the upper surface of left gripper lower arm 84. Finally, the lowermost portion lies between the rubberized blocks 88 of the right gripper lower arm 85 and the lower surface of the left gripper lower arm 84.

By virtue of this arrangement, as the grippers 52, 53 are retracted from their FIG. 4B positions of mutual interpenetration, the left gripper blocks 87 slide along and within the recesses of the right gripper upper arm 86 and the right gripper blocks 88 slide along and within the recesses of the left gripper lower arm 84, whereby the grippers become gradually disengaged from each other. The aforementioned uppermost and lowermost fold-defined portions of the bag 3, which are in contact with the gripper-carried rubberized blocks 87, 88, respectively, are dragged by the blocks as the grippers move apart. Since each such bag portion is defined by the two superposed sheets which form the two opposed sides or faces of the bag 3, in practice the outer surface of each such sheet, being in contact with a respective one of the sets of rubberized blocks 87, 88, is firmly held by the blocks while the inner surface of each sheet is freely slidable on the inner surface of the other sheet. Where the bags 3 are fabricated, as is currently preferred, of a suitable nonelastic plastic material, such relative sliding of the inner sheet surfaces is further facilitated by the low friction coefficient of the plastic material. Thus, as the two grippers 52, 53 are withdrawn and move away from each other, they carry with them—preferably aided by the different coefficients of friction of the rubberized blocks 87, 88 and the bag material—the two opposite faces or sides of the bag 3 which is accordingly thereby opened.

FIG. 4C depicts the grippers 52, 53 in the course of their mutual withdrawal from the FIG. 4B positions of cooperative interpenetration. The bag 3 is gradually opened by the moving apart of the grippers 52, 53 which, during such withdrawal, are both closed by the action of the respective springs 89, 90. During this return stroke the pin 95 slides within and along the groove 96 although the lever 94 is, at that time, in the illustrated inclined orientation under the urgency of a coil spring 101 (see FIG. 3) that hingedly and resiliently joins the small lever 92 to the lever 94. In this position an extension 102 of the lever 94 no longer engages a lock pin 91 of the small lever 92 and, as a consequence, the lever 94 remains in the inclined orientation seen in FIG. 4C. The operation of the right gripper 53 during the withdrawal or separation of the grippers is similar and should now be apparent.

In FIG. 4D the grippers 52, 53 have reached their positions of maximum separation and, accordingly, the two faces of the bag 3 are likewise fully spaced apart. The pin 95, after arriving at the highest or most elevated part of the mouth of groove 96, has wholly disengaged from within the groove, thereby enabling the bias of spring 101 to restore the lever 94 to its vertical orientation in which its extension 102 is once again in surface-abutting engagement with the lock pin 91 of the small lever 92. In this position, when the pin 95 is subsequently driven into the groove 96 by the mutual approach of the left and right grippers 52, 53 to effect the opening of another bag 3, it will cause the lowering of the small lever 92 and the raising of left gripper upper arm 83 so as to open the gripper 52. At that time—presumably when the currently-grasped bag 3 has been suitably filled or packed with articles—the filled bag will become disengaged from the gripper 52, and likewise from the gripper 53, permitting its ejection or discharge from the apparatus of the invention.

Also shown in FIG. 4D is one of the flaps (54) that has been downwardly pivoted, thereby facilitating or effectuating the outward displacement of one of the bag sides defined between the two opposed faces which are grasped by the grippers 52, 53 and thereby assuring that the bag, as held below the hopper 8, is in its fully open condition for the receipt of articles to be bagged. In addition to outwardly displacing the bag side, the downward pivoting of the flap 54 is also effective to flatten the side gussets or bellows of the handle-incorporating bag 3. The flap 55, located at the opposite side of the bag opening device and not, therefore, visible in FIG. 4D, operates in the same manner as the flap 54 and performs like functions as to the opposite side of the bag. Thus, the opening device of the invention, including the spaced apart grippers 52, 53 and the pivotable flaps 54, 55, is effective to maintain the bag 3 in its fully open condition with a mouth of substantially rectangular shape generally corresponding to the shape and size of the hopper 8 under which the bag is held for the smooth introduction and receipt of articles.

FIGS. 5A to 5D successively illustrate the pivotal movements of the flaps 54, 55. In FIG. 5A the flaps 54, 55 are seen in their horizontal positions also depicted in FIG. 3. In this initial position the flaps 54, 55 carry out their other function, namely that of avoiding the premature or accidental introduction of either hands or objects into a bag 3. The phantom lines in the Figure indicate the rocking lever 63; in actuality, the rocking lever is not disposed closely proximate the gripper 53 (as shown) but is, rather, closely proximate the gripper 52 (see FIG. 3), the so modified FIG. 5A depiction being solely for ease of description. In any event, the rocking lever 63 is oscillatable about its fulcrum 104 and is pivotally attached at pin 105 to the free or outbound end of the arm 66 of the solenoid 62. When the solenoid is not excited, the arm 66—under the urgency of a spring (not shown)—is shifted downwardly, thus lowering the pin 105 and, with it, that portion of the rocking lever 63 located to the left (in the Figure) of its fulcrum 104. This results in a downward rotation of a lever 75 pivotally joined at one end to the left end of lever 63 and secured at the other to the hub 65 of flap 55. The downward rotation of lever 75 effects a counterclockwise rotation of hub 65 whereby flap 55 is pivoted to its horizontal position shown in FIG. 5A.

As the left-shown side or end or arm of the rocking lever 63 is lowered about the fulcrum 104, the right side or end or arm is correspondingly pivoted upward. This carries with it an upward rotation of the lever 74 which has one end pivotally joined to the right end of rocking lever 63 and the other secured to the hub 64 of flap 54. The upward rotation of lever 74 causes a clockwise rotation of hub 64 by which the flap 54 is carried into the horizontal orientation seen in FIG. 5A.

As indicated in FIGS. 5B and 5C, during the mutual interpenetration and subsequent withdrawal of the grippers 52, 53 the pivotable flaps 54, 55 are maintained in their horizontal positions blocking the introduction of articles, through the hopper 8, into the underlying open bag support region of the apparatus. With the flaps 54, 55 thus disposed, the extension 67 (FIG. 2) of the rocking lever 63 presses against the security sensor or switch 68 and any inwardly-directed pivotal movement of either flap—either accidentally or through the intentional placement of pressure on one of the flaps—releases and thereby actuates the sensor 68 and causes the apparatus to immediately discontinue all operations.

When the solenoid 62 is subsequently energized (FIG. 5D), the arm 66 is upwardly shifted, raising the pin 105 and causing a rotation of the rocking lever 63 about its fulcrum 104. In so rotating, the left end (in the Figures) of lever 63 rises, correspondingly raising the pivotally attached end of lever 75. The hub 65, connected to the opposite end of lever 75, is in turn rotated in the clockwise sense and the attached flap 55 is downwardly pivoted or tilted.

The upward shifting of arm 66 upon energizing of the solenoid 62 also causes a lowering of the righthand end of the rocking lever 63 to which one end of the lever 74 is pivotally secured. This lowering of the lever 74 drives the hub 64 (to which the opposite end of lever 74 is attached), and the flap 54 secured to the hub, through a counterclockwise rotation by which the flap is downwardly pivoted as shown in FIG. 5D. Downward pivoting or tilting of the flaps 54, 55 permits ready access of articles through the hopper 8 to a bag 3 held open immediately below the hopper by the bag opening device of the invention and, in addition, facilitates maintenance of the bag in its open condition by spacing apart the handles and upper portion of the bellows or folds of the open bag.

The operation of the apparatus of the invention will now be described. It is assumed, for ease of description, that the apparatus is located at and forms an integral part of the checkout station of a supermarket or like retail establish although, as should be apparent, the invention has significantly broader utility and its use in numerous additional unrelated applications is contemplated. At the commencement of an operating cycle the flaps 54, 55 are disposed in their horizontal positions in which they obstruct the passage of articles into the apparatus interior through the hopper. When a customer or checkout counter operator requires a bag within which to pack purchased articles, he or she manually depresses a pushbutton (not shown) to actuate the motors 7 and 27 of the bag dispensing device. The resulting rotation of the roller 6 effects an unwinding movement of the reel 1 whereby the leading bag 3, still attached to the remainder of the continuous web 2, is driven upwardly first by the lower belt units 15, 16 and, from there, by the small round belts 71 (FIG. 2). As the bottom edge of the leading bag 3 passes the photoelectric array elements 41, 41', the photocell elements are no longer obscured by the bag and trigger a reversal in the rotative direction of the motor 27 and a consequent reversal in the rotational direction of the rollers 22, 23 and of the roller-driven belts of the lower belt units 15, 16. At the same time, the freewheels 26, 26' are effective to prevent further web-carrying movement of the belts of the upper belt units 31, 32. The reverse movement of the lower driving unit belts and the concurrent cessation of movement of the upper driving unit belts causes a single bag 3—the leading bag—to to be, for example, frangibly detached from the remainder of the continuous web 2. The detached bag 3 is then advanced by the upper belt units 31, 32 to a position immediately below the mouth of the hopper 8 to be there opened and held open for the receipt therein of articles to be packed.

With the bag thus located immediately below the hopper 8, the two grippers 52, 53 move simultaneously from their FIG. 4A positions toward the substantial centerline of the hopper 8 (FIG. 4B) at which they mutually intermesh or interpenetrate, as heretofore described, and grasp the two opposite faces of the bag 3. The grippers are then retracted to their original positions, driven by the motor 60, thereby opening the bag. Upon the return of the grippers to their positions of maximum separation, the flaps 54, 55 are downwardly pivoted, thus providing free and unemcumbered access to the bag 3 through the hopper 8 and maintaining the bag sides in spaced apart relation during the filling of the bag with purchased articles.

By the point at which the bag 3 has been opened and the flaps 54, 55 have been downwardly pivoted into their substantially vertical orientations, the motor 33 has driven the loading platform 38 to its highest or uppermost position for supporting the bag 3 during the initial introduction of articles into the bag. At this position the bag 3 is supported on the loading platform not by the bag bottom but, rather, by an area of the bag located (by way of example) slightly above the middle thereof (FIG. 2). As should be evident from FIG. 2, in this first position of the platform 38 approximately the lower half of the bag, including its bottom, hangs loosely downward through the aperture 39 defined between the two half-plates of the loading platform 38.

The customer or employee operator may then selectively introduce articles, through the hopper 8, into the upper half of the supported bag 3 until the level of the packed articles reaches and obstructs, or is at least proximate, the photocell array 51. Should there yet remain additional articles to be bagged, the customer or operator once again depresses the starting pushbutton, thereby activating the motor 33 which lowers the loading platform 38 to a position immediately below the bottom of the bag 3 so that the bag remains fully supported for that additional time required to complete the filling thereof. Additional articles can then be introduced into the bag 3 through the hopper 8 until either the articles to be packed have been exhausted or the uppermost level of articles contained in the bag once more blocks or obscures the photocell array 51.

With the bag 3 thus containing either all remaining articles to be packed or its maximum volume of such articles, the customer or operator once more—i.e. for the third time—depresses the starting pushbutton. This initiates a further and final descent of the loading platform 38 by an amount at least as great as the overall vertical dimensions of the opening device and, in any event, sufficient to assure that the top of the bag will not interfere with or unintendedly engage any interior parts or elements of the apparatus as the bag is subsequently ejected therefrom. Thus, by virtue of this final descent of the loading platform 38, the top of the bag 3—and more particularly the topmost level of articles contained in the bag—is brought below the opening device. The filled bag 3 is now accordingly prepared for lateral ejection from the interior of the apparatus, without interference, after its release by the grippers 52, 53.

If, prior to the final descent of the loading platform 38, the photocell array 51 remains obscured by articles contained in the bag 3, the motors 33, 50, 60 are deactivated thereby preventing further driven movement of the loading plate 38, grippers 52, 53 and ejector 44. When all excess articles have thereafter been removed from the bag, the starting pushbutton is once more depressed and, assuming that the photocell array 51 is no longer blocked by bagged articles, the motor 33 lowers loading platform 38 to a height substantially even with ejection plate 43 and motor 50 drives the ejector 44 to slidably transport the filled bag—already released by the grippers 52, 53—along the ejection plate at least until it reaches the position illustrated and remove it from the outbound end of the ejection plate 43. If there still remain additional articles to be packed in bags, the customer or operator once more depresses the starting pushbutton and thereby initiates a new operating cycle of the inventive apparatus.

The operations of the bag dispensing, delivering, opening and retaining devices and associated elements of the apparatus, as well as the overall operation of the apparatus as a whole, are coordinated and controlled by a control system that may, for example, advantageously incorporate or comprise a conventional microprocessor or the like. Such control system may be implemented in any suitable manner and as a matter of design choice by those of ordinary skill in the art and, accordingly, no further detailed description thereof is deemed necessary to enable the intended practice of the invention.

Figure 7:
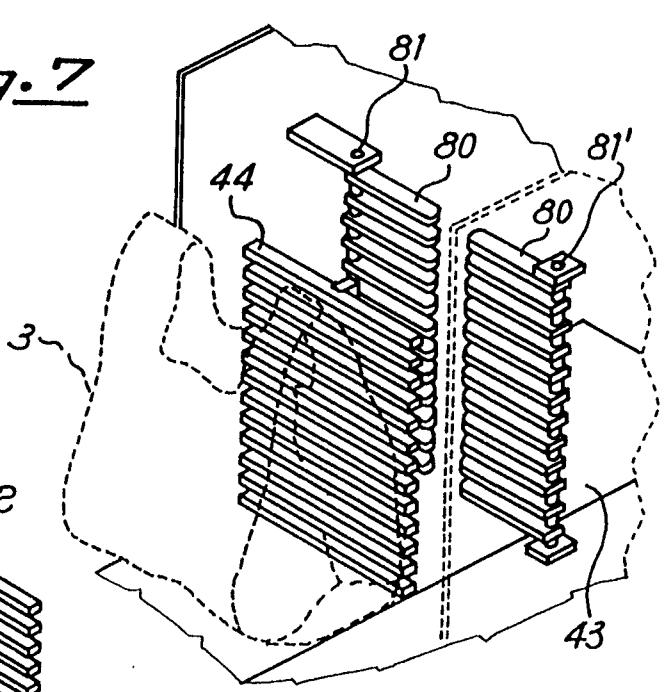
FIGS. 6 to 8 are elevated perspective views of a modified embodiment of a bag ejecting device of the inventive apparatus shown at three discrete time intervals.
Figure 8:
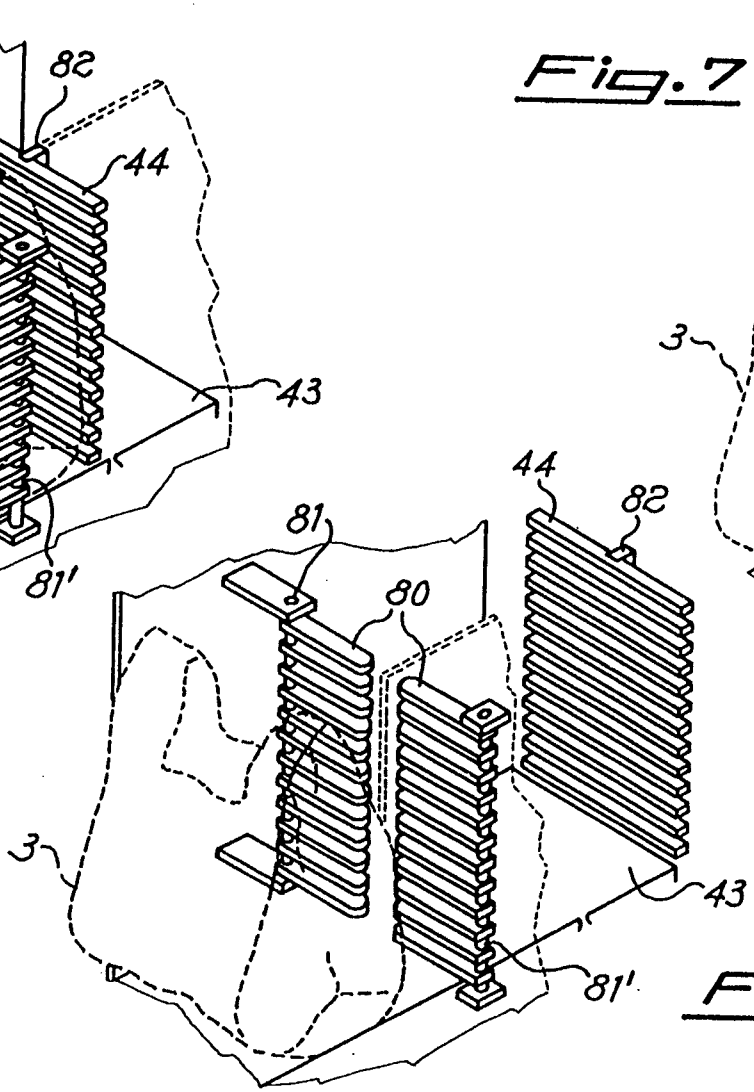
Figure 6:
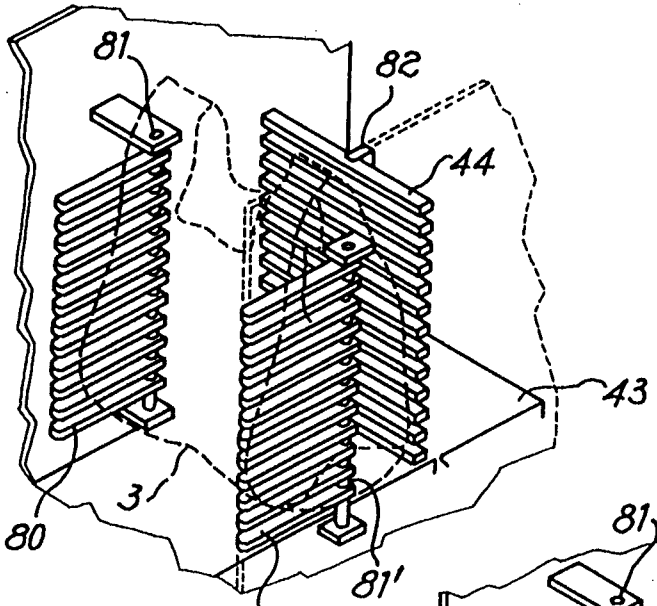

FIGS. 6 to 8 illustrate a preferred variation of the filled bag ejection device of the present invention. This variation provides, inter alia, enhanced safety features and includes a small gate 80 for closing off the area or space immediately above the ejection plate 43 so that the plate 43 remains clear for the free and unobstructed passage therealong of the ejector 44 and of a filled bag 3' driven by the ejector. The gate 80 also prevents a filled bag, already discharged from the apparatus interior by the ejector 44, from falling over or otherwise tilting backward on the ejection plate 43 and thereby obstructing the passage of a subsequent filled bag along the plate. The gate 80 is formed by a pair of doors pivotally mounted on spaced apart hinge-defining posts 81, 81', each of the doors consisting of a plurality of substantially parallel and horizontally oriented comb-like pickets.

The filled bag ejector 44 is similarly constructed of a plurality of substantially parallel and horizontally oriented, spaced apart pickets such as those of which the gate 80 is formed. The ejector pickets are mounted one above the next along the length of a vertical pin 82 sized for free passage through a gap defined between the two doors of the gate 80 when the gate doors are disposed in their closed (i.e. FIG. 8) position. The ejector 44 is furthermore located—and the spacings or gaps between adjacently-disposed pickets of each of the gate 80 and the ejector 44 are dimensioned—so that the ejector pickets are level or aligned with the gaps between the gate pickets. By virtue of this arrangement, when motor-driven movement of the filled bag ejector 44 carries it across the fixed position of the gate 80, it is free to pass outwardly beyond that position since the pin 82 is movable through the gap defined between the closed doors of the gate 80 and the ejector pickets are movable through the gaps defined between the adjacently-disposed gate door pickets.

FIG. 6 depicts the ejector 44 as it drives before it a bag 3—represented by the phantom lines in the drawing—along the ejection plate 43. It should be recognized that, as the thus driven bag abuts the gate doors, the doors swing or otherwise pivot open about the posts 81, 81' under the ejector-driven force of the bag. In FIG. 7 the bag 3, and the ejector 44, has passed through and beyond the gate 80 and the gate doors have returned to their closed positions under, for example, the urgency of return springs (not shown) which act upon the hinge-defining posts 81, 81'. FIG. 8 illustrates a later condition or step in which the ejector 44 is returning to its starting position after having passed freely through the closed gate doors. As seen in FIG. 8, the filled bag 3 is prevented from tilting or falling backward on the ejection plate 43 because of the presence of gate 80, the doors of which are pivotable to open the gate only in the ejection direction of a bag. In addition, the return springs are effective of normally maintain the gate 80 in its closed condition and thereby prevent both accidental and intentional introductions of, for example, customer limbs and other objects into the interior of the apparatus during its operation.

An apparatus constructed in accordance with the present invention may also be conveniently provided with a covering element or housing that, while enabling free access to the mouth of hopper 8, covers and protects the other portions and elements of the apparatus. Due at least in part to its lightweight and relatively compact structure, the inventive apparatus can be readily shifted about for placement in the most suitable areas of a supermarket or other similar sale or checkout stations. To this end, the apparatus may advantageously be provided with wheels for facilitating its movement from location to location and with suitable wheel brakes or locks for selectively fixing its position against unintended movement.

While there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. It is the intention, therefore, to be limited only as indicated by the scope of the claims appended hereto.

What is claimed is:

1. Apparatus for feeding a single flexible bag with handles and lateral pleats to an article-receiving station from a continuous web of successively joined, preformed bags disposed so that the bottom of each bag in the web is frangibly attached to the handles at the top of the next following bag in the web and wound about a central core (4) so as to form a reel (1) of the web, said apparatus comprising:

means for delivering the web to the article receiving station with the top of each bag downstream of the bottom of each respective bag;

first means for isolating a single bag portion of said continuous web corresponding to a single leading bag, for detaching said single bag portion from said continuous web (2) by retracting said continuous web from said leading bag to create a single detached leading bag (3), and for delivering said single, closed, detached leading bag to the article-receiving station so that the top of the leading bag is delivered to the article receiving station prior to the bottom of said bag, said first means comprising a pair of cooperating lower drive belt units (15, 16) arranged to contact opposite faces of said web; and second means at the article receiving station for opening the closed, detached leading bag (3) delivered by said first means and for maintaining the detached leading bag in an open condition at the article-receiving station to enable the selective introduction of articles into the open bag, said second means including a pair of opposed and relatively movable grippers (52, 53) operable for grasping opposed sides of the detached leading bag so as to open the bag and then maintain the open condition of the bag as the bag is filled with articles.

2. Apparatus in accordance with claim 1, wherein said first means further comprises:

a roller (6) for supporting the continuous web reel (1);

driving means (7) operable for rotating the roller (6) so as to unwind a longitudinal portion of the continuous web (2) from the reel (1);

a pair of opposed upper driving belt units (31, 32) for gripping therebetween a leading bag (3) of the web (2), said upper belt units (31, 32) being disposed in superposed relation to said lower driving units (15, 16); and bidirectional drive means operable in a first sense for driving said lower belt units in a forward direction for advancing the web (2) and the leading bag (3) thereof toward said upper belt units, and for concurrently driving said upper belt units in a forward direction for advancing the leading bag to the article-receiving station to be there opened and maintained open for the receipt of articles in the bag, and in a second sense for driving said lower belt units in a reverse direction for retracting the web while preventing reverse-direction movement of said upper belt units so that, as the web is retracted by the lower belt units, the leading bag is held stationary by said upper belt units such that the leading bag is frangibly detached from the retracting web for subsequent delivery by the upper belt units to the article-receiving station.

3. Apparatus in accordance with claim 1, further comprising a hopper (8) located immediately above the article-receiving station and through which articles are introducible into a detached bag maintained in open condition at the station, and wherein said second means further comprises:

means for horizontally reciprocating said grippers (52, 53) between a first position spacing apart said grippers and at which the grippers grasp the opposed sides of the detached leading bag (3) to hold and maintain the bag in its open condition, and a second position of mutual proximity of said grippers and at which the grippers operably grasp the opposed sides of the closed, detached leading bag which has been advanced to the article-receiving station by said first means and then open the bag as the grippers are returned from their second to their first position; and a pair of flaps (54, 55) pivotally movable between a first, substantially horizontal orientation in which the flaps substantially close the hopper so as to prevent the introduction of articles through the hopper to the article-receiving station, and a second, substantially vertical orientation in which the flaps overlie at least portions of second opposed sides of the leading bag that is held open at the article-receiving station by said grippers (52, 53) so as to further maintain the open condition of the leading bag for the receipt of articles therewithin.

4. Apparatus in accordance with claim 1, further comprising third means for supporting the leading bag as articles are introduced into the open bag at the article-receiving station, and for ejecting the bag, when the bag is filled with articles, from the apparatus.

5. Apparatus in accordance with claim 4, wherein the leading bag has a longitudinal length and said third means comprises:

a vertically-reciprocatable loading platform (38) for supporting the open leading bag as articles are introduced into the bag;

means operable for vertically reciprocating said platform between at least a first raised position in which a longitudinal portion of the leading bag less than the length thereof is initially presented, when the bag is opened by said second means, for the receipt of articles in the open bag, and a second lowered position in which substantially the full length of the open leading bag is presented for the receipt of articles in the bag so that, after the bag has been filled with articles while supported by the platform in said first position of the platform, said platform is lowered by said operable means to said second position to enable the continued introduction of additional articles into the open bag; and a horizontally-reciprocatable ejector (44) for discharging the leading bag from the apparatus after the bag has been filled with articles.

6. Apparatus in accordance with claim 2, wherein said lower driving belt units (15, 16) comprise a pair of driving rollers (22, 23), a pair of lower rollers (17, 18), a plurality of belts trained for bidirectional movement about said driving and lower rollers and between opposed ones of which the web is engageable for advancing and retracting movement of the web, and lever means (19) connected to one (17) of said lower rollers for selectively displacing said one lower roller (17) from the other of said lower rollers (18) so as to facilitate feeding of a leading end of the continuous web (2) from the reel (1) into a nip defined between said lower belt units (15, 16).

7. Apparatus in accordance with claim 6, wherein said lower driving belt units (15, 16) further comprise an intermediate roller (20) interposed between said driving and lower rollers, and said lever means comprises a lever (19) having a fulcrum at said intermediate roller and about which said lever is pivotable for selectively displacing said one lower roller (17) from the other lower roller (18).

8. Apparatus in accordance with claim 2, wherein said upper driving belt units (31, 32) comprise a pair of upper rollers (29, 30), a superposed pair of idler rollers (56, 57), and a plurality of drive belts (31, 32) trained about the upper and idler rollers.

9. Apparatus in accordance with claim 2, wherein said lower driving belt units (15, 16) include a pair of driving rollers (22, 23) and said upper driving belt units (31, 32) include a pair of upper rollers (29, 30), and said bidirectional drive means comprises motor means connected to and operable for rotating one of said upper rollers pair (29, 30) or said driving rollers pair (22, 23), and a drive chain connecting said upper and driving rollers pairs so as to transfer the rotation of the motor means driven one of said upper and driving roller pairs to the other of said roller pairs.

10. Apparatus in accordance with claim 9, wherein said second means further comprises a plurality of transport belts disposed spanningly between said lower driving belt unit driving rollers (22, 23) and said upper driving belt unit upper rollers (29, 30) for assisting advancing movement of the leading bag (3) on the continuous web (2) bridgingly from said lower belt units to said upper belt units as said lower and upper belt units are driven in said second direction by said bidirectional drive means.

11. Apparatus in accordance with claim 6, wherein said lower driving belt units (15, 16) further comprise a first intermediate roller (20) interposed between said driving and lower rollers and defining a fulcrum about which said lever means is pivotable for selectively displacing said one lower roller (17) from the other lower roller (18), and a second intermediate roller (21) about which the belts of the two lower driving belt units (15, 16) rotate in opposition for retaining the continuous web between said opposed belts during the transport of the web by and along said lower driving belt units.

12. Apparatus in accordance with claim 2, further comprising photocell array means (41, 41') located between said lower and upper belt driving units for determining the time at which the operative sense of said bidirectional drive means should be reversed, from said first sense in which the web and the leading bag thereon is advanced by the lower and upper belt units to said second sense in which the web is retracted by said lower belt units while the leading bag is held stationary by said upper belt units so as to thereby frangibly detach the leading bag from the web, by detecting passage beyond said photocell array means of the bottom of the leading bag (3) on the continuous web (2) as the web is advanced by said lower belt units (15, 16).

13. Apparatus in accordance with claim 5, wherein said loading platform comprises two half-plates separated by an aperture through which the leading bag (3), detached from the continuous web (2), is advanceable by said first means to the article-receiving station at which the detached bag is opened by said grippers (52, 53).

14. Apparatus in accordance with claim 5, wherein said ejector (44) comprises a plurality of parallel, horizontally-oriented pickets, and wherein said apparatus further comprises a filled bag discharge opening and a gate located proximate said opening and formed of two doors unidirectionally outwardly pivotable for enabling ejector-driven discharge of a filled bag from the apparatus through said opening, each of said two doors comprising a plurality of parallel, horizontally-oriented pickets in a comb-like arrangement.

15. Apparatus in accordance with claim 1, wherein said second means further comprises means for horizontally reciprocating said grippers (52, 53) between a first position spacing apart said grippers and at which the grippers grasp the opposed sides of the leading bag (3) to hold and maintain the bag in its open condition, and a second position of mutual interengaged proximity of said grippers and at which the grippers operably grasp the opposed sides of the closed leading bag which has been advanced to the article-receiving station by said first means and then open the bag as the grippers are returned from their second to their first position, and each said gripper (52, 53) comprising a first arm (83, 85), a second arm (84, 86) and spring means (89, 90) disposed between said first and second arms for normally urging said first and second arms relatively one against the other with a side of the leading bag held grippingly therebetween, said first arm (83, 85) carrying thereon a plurality of rubberized blocks (87, 88) for facilitating gripping of a bag side, and said second arm (84, 86) having a plurality of recesses defined therein, said recesses being sized and shaped for accommodating said rubberized blocks as said first and second arms are moved relatively one against the other under the urgency of said spring means (89, 90).

16. Apparatus in accordance with claim 1, further comprising a hopper (8) located immediately above the article-receiving station and through which articles are introducible into a detached bag maintained in open condition at the station, and wherein said second means further comprises:

a pair of flaps (54, 55) pivotally movable between a first, substantially horizontal orientation in which the flaps substantially close the hopper (8) so as to prevent the introduction of articles through the hopper to the article-receiving station, and a second, substantially vertical orientation in which the flaps overlie at least portions of second opposed sides of the detached leading bag (3) that is held open at the article-receiving station by said grippers (52, 53) so as to further maintain the open condition of the leading bag for the receipt of articles therewithin; and operating means for moving said flaps (54, 55) between said first and second positions thereof, said operating means comprising a rocking lever (63) disposed for pivotal movement about a fulcrum (104) located intermediate its ends and connected at one end of the rocking lever to one of said flaps (54) and at the other end of the rocking lever to the other of said flaps (55), and an actuator (62) connected to said rocking lever (63) and operable for pivoting said rocking lever and thereby pivotally moving said flaps (54, 55) between said first and second positions of the flaps.

17. Apparatus in accordance with claim 16, wherein said operating means further comprises a first hub (64) on said one flap (54) and a first small lever (74) connecting said first hub to said one end of said rocking lever (63), and a second hub (65) on said other flap (55) and a second small lever (75) connecting said second hub to said other end of the rocking lever.

18. Apparatus in accordance with claim 5, further comprising a hopper (8) located immediately above the article-receiving station and through which articles are introducible into a detached bag maintained in open condition at the station, and wherein said third means further comprises ejector drive means operable for reciprocatably moving said ejector (44) in a first direction for discharging the detached leading bag from the apparatus after the bag has been filled with articles and in a second direction for returning the ejector to its initial position after the filled bag has been discharged, and photocell array means (51) located proximate said hopper (8) for preventing operation of said ejector drive means when the photocell array means is obscured by articles contained in an open bag disposed in the article-receiving station.

19. Apparatus in accordance with claim 5, wherein said platform (38) is further movable by said operable means to a third position below said second position and from which the filled bag supported on said platform is dischargeable from the apparatus by said ejector (44).

* * * * *